US007673688B1

(12) United States Patent
Jones et al.

(10) Patent No.: US 7,673,688 B1
(45) Date of Patent: Mar. 9, 2010

(54) CASING WIPING DART WITH FILTERING LAYER

(75) Inventors: Desmond Jones, Duncan, OK (US); David Szarka, Duncan, OK (US); Brett Fears, Duncan, OK (US); Earl Webb, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 12/207,002

(22) Filed: Sep. 9, 2008

(51) Int. Cl.
*E21B 37/04* (2006.01)

(52) U.S. Cl. ..... 166/311; 166/153

(58) Field of Classification Search ..... 166/152, 166/153, 154, 311
See application file for complete search history.

(56) References Cited

U.S. PATENT DOCUMENTS

| | | | | |
|---|---|---|---|---|
| 6,973,966 | B2 | 12/2005 | Szarka | |
| 7,255,162 | B2 | 8/2007 | Stevens et al. | |
| 7,559,363 | B2 * | 7/2009 | Howell et al. | 166/153 |
| 2005/0103504 | A1 * | 5/2005 | Szarka | 166/386 |
| 2008/0149336 | A1 | 6/2008 | Szarka et al. | |
| 2008/0164031 | A1 * | 7/2008 | Howell et al. | 166/305.1 |

FOREIGN PATENT DOCUMENTS

| | | | |
|---|---|---|---|
| EP | 1 903 180 | A1 | 3/2008 |
| WO | WO2005/052312 | A1 | 6/2005 |
| WO | WO2005/052316 | A2 | 6/2005 |
| WO | WO2005/108738 | A1 | 11/2005 |
| WO | WO2008/078070 | A1 | 7/2008 |

* cited by examiner

*Primary Examiner*—William P Neuder
(74) *Attorney, Agent, or Firm*—John W. Wustenberg; Baker Botts, LLP

(57) ABSTRACT

A dart may include a foam body, a filtering material at least partially covering the foam body, and a mandrel. The foam body may surround the mandrel.

11 Claims, 5 Drawing Sheets

CASING WIPING DART WITH FILTERING LAYER

BACKGROUND

The present disclosure generally relates to subterranean operations. More particularly, the present disclosure relates to improved darts for use in subterranean wells.

During the drilling and construction of subterranean wells, casing strings are generally introduced into the well bore. To stabilize the casing, a cement slurry is often pumped downwardly through the casing, and then upwardly into the annulus between the casing and the walls of the well bore. One concern in this process is that, prior to the introduction of the cement slurry into the casing, the casing generally contains a drilling fluid or some other servicing fluid that may contaminate the cement slurry. To prevent this contamination, a plug, often referred to as a cementing plug or a "bottom" plug, may be placed into the casing ahead of the cement slurry as a boundary between the two. The plug may perform other functions as well, such as wiping fluid from the inner surface of the casing as it travels through the casing, which may further reduce the risk of contamination.

Similarly, after the desired quantity of cement slurry is placed into the well bore, a displacement fluid is commonly used to force the cement into the desired location. To prevent contamination of the cement slurry by the displacement fluid, a "top" cementing plug may be introduced at the interface between the cement slurry and the displacement fluid. This top plug also wipes cement slurry from the inner surfaces of the casing as the displacement fluid is pumped downwardly into the casing. Sometimes a third plug may be used, to perform functions such as preliminarily calibrating the internal volume of the casing to determine the amount of displacement fluid required, for example, or to separate a second fluid ahead of the cement slurry (e.g., where a preceding plug may separate a drilling mud from a cement spacer fluid, the third plug may be used to separate the cement spacer fluid from the cement slurry), for instance.

In certain applications, for example, when drilling offshore, the casing string may be lowered into the hole by a work string, which is typically a length of drill pipe. Because most cementing plugs are too large to pass through the work string, sub-surface release ("SSR") plugs are used. These plugs are often suspended at the interface of the drill pipe and the casing string, and are selectively released by a remote device when desired. Because SSR plugs are suspended at the interface between the work string and the casing, fluids must be able to pass through the plugs. However, when used to prevent contamination as described above, the channels through the plugs must be selectively sealed.

Several methods are known in the art for sealing the channels through SSR plugs. For example, if the channel is funnel-shaped, then a weighted ball may be dropped into the funnel in the plug to seal it. Another method involves a positive displacement plugging device, often referred to as a "dart." Darts generally comprise two or more rubber "fins" that flare outwardly from a mandrel or stem. Such fins are generally sized to engage the inside wall of the pipe in which they are deployed. Because its fins prevent a dart from free falling to the plug, a pressure differential, or otherwise downward flow of fluid, usually is applied to force the dart to the plug.

When used to release plugs, the fins of a dart must collapse or compress sufficiently to allow the dart mandrel to advance through the work string and reach the intended plug. In some instances where there is a plurality of plugs, each succeeding plug may have a successively smaller minor diameter channel such that successively larger dart noses can be used to release the plugs in sequence. Thus, a particular dart must be capable of collapsing to a small enough diameter to reach an intended plug. Several problems, however, have been encountered with conventional darts in such applications. For instance, when a conventional dart has fins that are properly sized to engage the inside wall of the work string, such fins may approach an equivalent solid mass when compressed while passing through the minor diameter of successively smaller plugs; accordingly, excessive pressure may be required to push the dart (having fins in such compressed state) to the desired plug. Using excessive pressure is undesirable, because such excessive pressure may cause the cementing plug to be released prematurely and/or out of the desired sequence. Also, excessive pressure may cause the premature activation of some hydraulically set liner hangers which can provoke catastrophic problems in the proper execution of the cementing job. Moreover, a dart with easily compressible fins generally does not adequately engage the inner wall of the drill string and, therefore, does not act as an effective wiping device.

Foam darts, such as those disclosed in U.S. Pat. No. 6,973,966, can pass through more severe restrictions, but must re-hydrate or "swell" back into shape before being suited to sufficiently clean and displace. In order for a foam dart to swell completely within a reasonable time, the particulated fluid in which the dart sits must be quickly absorbed into the voids of the foam. However, due to the particulated nature of the fluid, it may start caking or bridging off or otherwise not readily entering the voids.

SUMMARY

The present disclosure generally relates to subterranean operations. More particularly, the present disclosure relates to improved darts for use in subterranean wells.

In one embodiment, the present disclosure provides a dart having a foam body, a filtering material at least partially covering the foam body, and a mandrel. The foam body may surround the mandrel.

In another embodiment, the present disclosure provides a method of cleaning a tubular string including introducing a dart having a foam body at least partially covered by a filtering material into the tubular string, moving the dart through the tubular string toward a restriction, allowing the dart to compress radially to move through the restriction, and allowing the dart to expand radially to maintain contact with the tubular string after passing through the restriction.

In yet another embodiment, the present disclosure provides a dart having a foam core, an outer portion surrounding the core, and a mandrel. The core may surround the mandrel.

DETAILED DESCRIPTION

Figure 1:
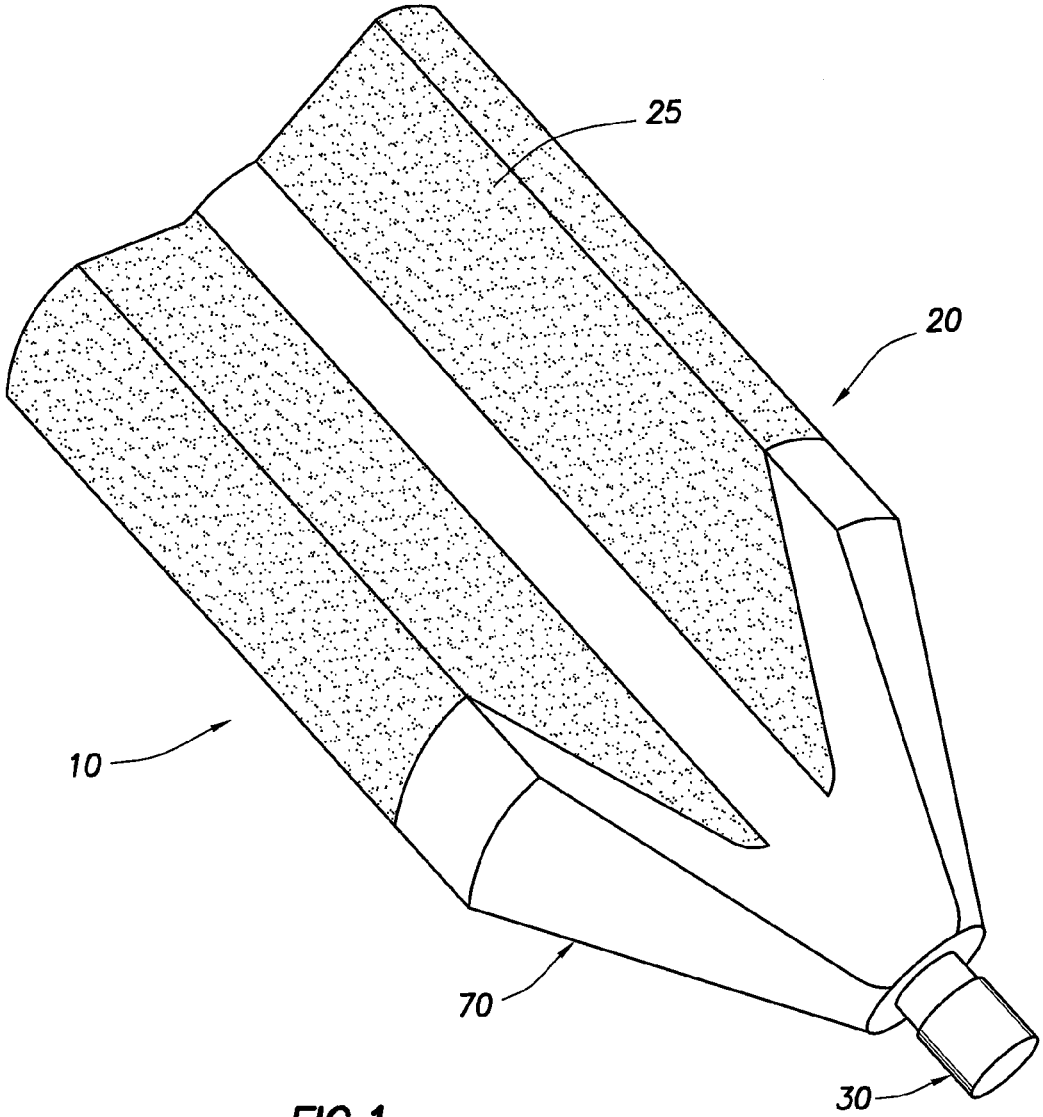
FIG. 1 is a perspective view of a foam dart in accordance with one embodiment of the present invention.

Referring now to FIG. 1, dart 10 may have foam body 20 surrounding mandrel 30. Foam body 20 may include an open cell low density foam 70 and a filtering material 25, such as reticulated open cell foam allowing a flexible composite dart that does not require clean water or air intake to achieve contact with an internal diameter of casing and/or tool after passing through a restriction. Rather, dart 10 may maintain contact after passing through a restriction by filtering and absorbing drilling mud or other fluids present in the environment.

Composite or layered foam dart 10 may wipe and displace in large diameter work strings as it moves through the string. Dart 10 may then compress radially as it passes through one or more severe restrictions (such as internal upset tool joints), while continuing to wipe and displace. In the event a portion of the fluid is displaced from within dart 10 upon radial compression, filtering material 25 may clean at a least a portion of the solids out of the fluid, allowing dart 10 to swell and regain a suitable shape. Thus, when low density foam 70 is allowed to expand radially after passing through restriction 90 (shown in FIG. 5B), it may fill with filtered fluid from the environment. Thus, the presence of particulated fluids is less likely to create undesirable bridging off or caking of solids. This may increase work string wiping efficiency by providing improved conformity to restrictions while allowing for swelling to inside diameter in a high-solids fluid in a downhole environment.

Foam body 20 may be sized to properly engage the inner wall of the largest diameter through which dart 10 will pass. For example, foam body 20 may wipe clean the inner wall of the drill pipe as dart 10 travels the length of the drill pipe, which length may extend the entire length of the well bore. Foam body 20 may also readily compress to pass through relatively small diameter restrictions without requiring excessive differential pressure to push dart 10 to the desired location. For instance, dart 10 may be used to wipe clean the inner wall of a drill pipe having an inner diameter that varies along its length. Foam body 20 may have a substantially cylindrical shape with a tapered leading edge and/or trailing edge, or it may have a constant cross section. Alternatively, foam body 20 may be reticulated, may have one or more ribs or fins or may have an otherwise varied cross section. When ribs or fins are present, gaps created in foam body 20 may be at least partially filled with a different material, such as a filtering material 25 or a foam with a different hardness. Generally, the outer diameter or other radial dimension of foam body 20 exceeds the corresponding dimension of nosepiece 40 (shown in FIG. 2) and mandrel 30. Low density foam 70 may be molded around and bonded to mandrel 30.

Low density foam 70 of foam body 20 may be any foamable material such as a polymer including, but not limited to, open-cell foams having natural rubber, nitrile rubber, styrene butadine rubber, polyurethane, or any other foamable material. Any open-cell foam having a sufficient density, firmness, and resilience may be suitable for the desired application, depending on the compression and strength requirements of the given application.

Filtering material 25 may be any material that is porous, having an air flow rate of at least 6 cfm when conducted on a standard 2×2×1 inch test sample, has good wear resistance comparable to typical cementing plugs and darts, is resistant to chemicals typically encountered in the well cementing process, has thermal resistant properties comparable to the elastomers used in typical cementing plugs, and is capable of bonding to low density foam 70. For example, filtering material 25 may be reticulated polyurethane foam having a cell density of approximately 10 to 40 cells per inch (cpi), fiberglass filtering media, metal mesh, or any other suitable porous or fibrous material. Filtering material 25 may bond to a trailing edge portion of low density foam 70. In certain embodiments, filtering material 25 may cover approximately 70% of foam body 20.

Figure 6:
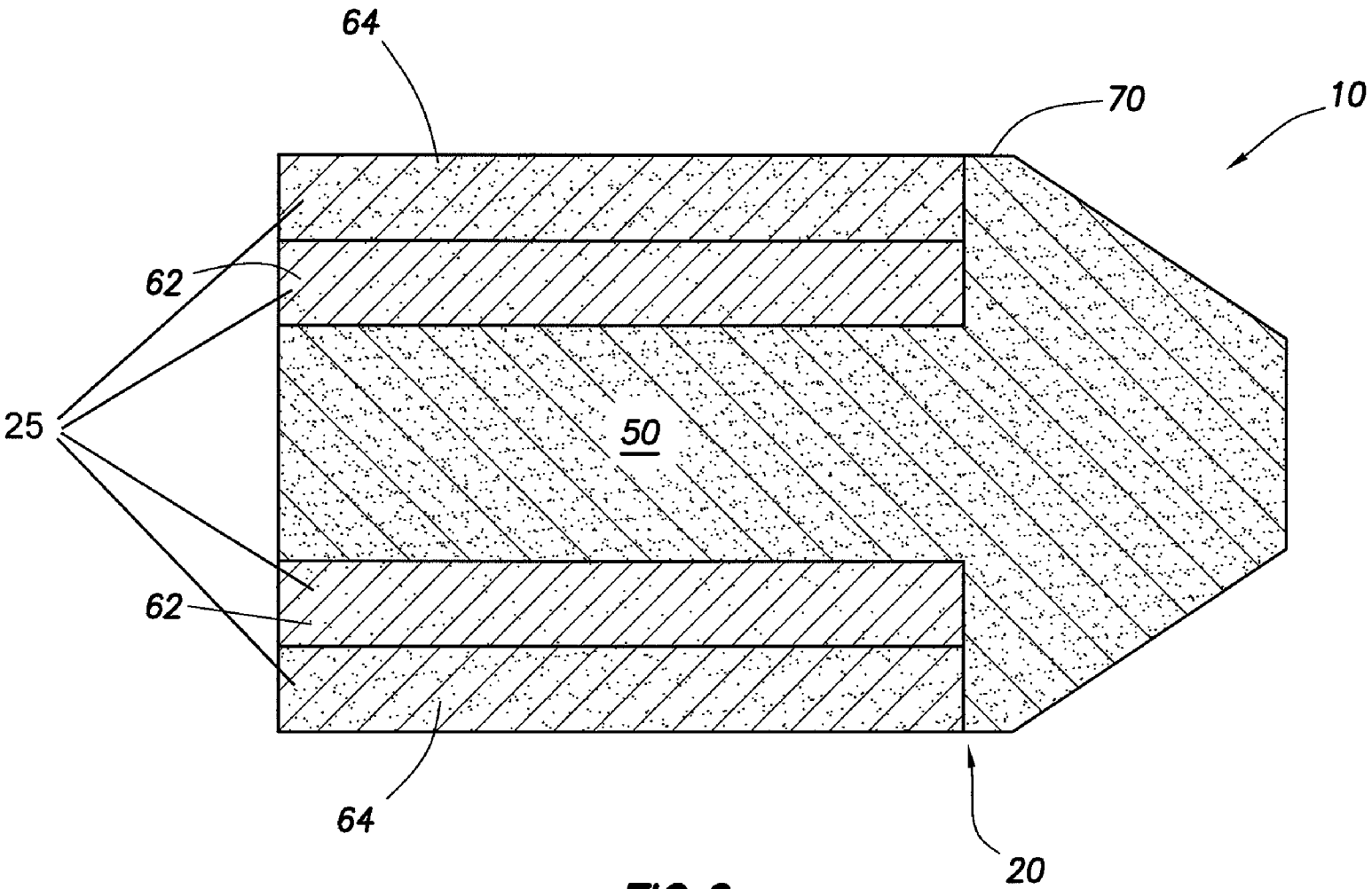
FIG. 6 is a side view of a foam dart in accordance with an embodiment of the present invention.

As illustrated in FIG. 6, filtering material 25 may have several graduated layers, with an outermost layer 64 having a composition which can filter larger solids and a subsequent inner layer 62 having a composition which can filter successively smaller solids. Thus, the outermost layer 64 may be more breathable relative to the remaining layers of filtering material 25. This staged filtering process may allow for improved re-hydration or swelling of the body 20 of dart 10 by separating the concentration of solids. Thus varying layers may provide the ability to stage the filtering process by removing larger solids on the outermost layer 64, with each subsequent inner layer capturing smaller solids, while re-hydration permits dart 10 to swell to a desired diameter. While two such layers are described, any number of layers may be used, depending on the particular characteristics of the environment.

The various layers in filtering material 25 may have the ability to prevent caking of solids suspended within a fluid while maintaining the wiping efficiency of dart 10. The use of varying layers may also allow dart 10 to be designed to match specific work string requirements, such as a higher abrasive surface, higher durability surface, or low compressive strength for exceeded restriction areas.

Dart 10 may thus conform to varying inside diameters and restrictions, allowing the use of specific tools which require restrictive orifices. Additionally, dart 10 may adapt to more casing work string sizes, resulting in fewer specific assembly configurations.

Figure 2:
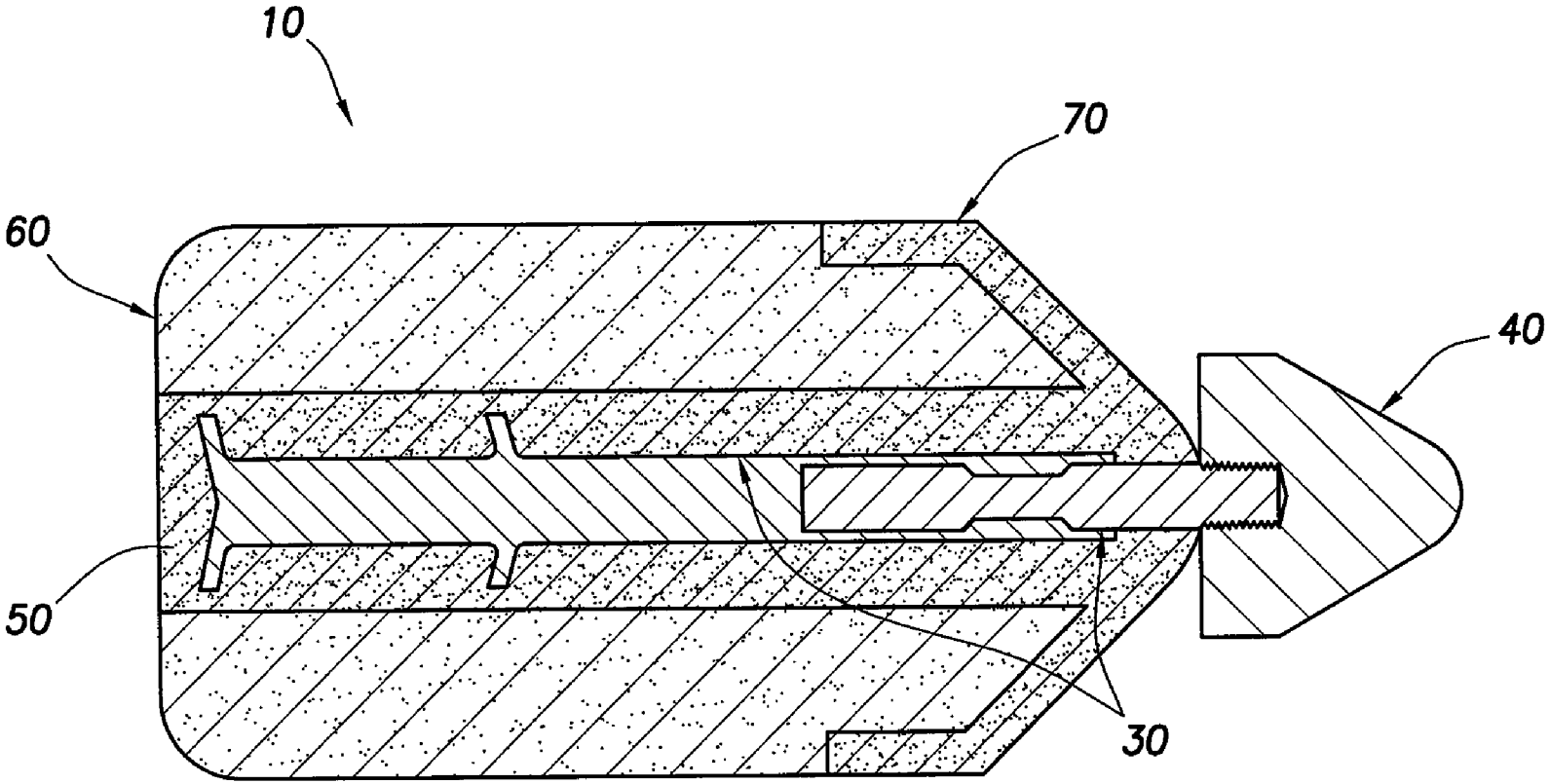
FIG. 2 is a side view of a foam dart in accordance with another embodiment of the present invention.
Figure 3:
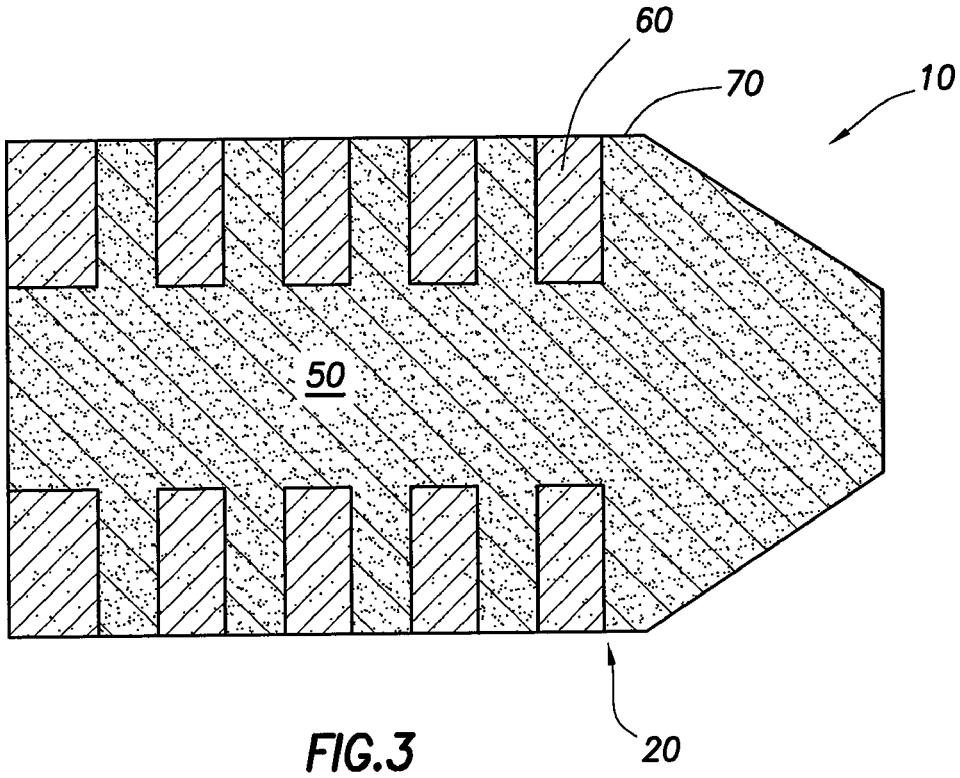
FIG. 3 is a side view of a foam dart in accordance with yet another embodiment of the present invention.
Figure 4:
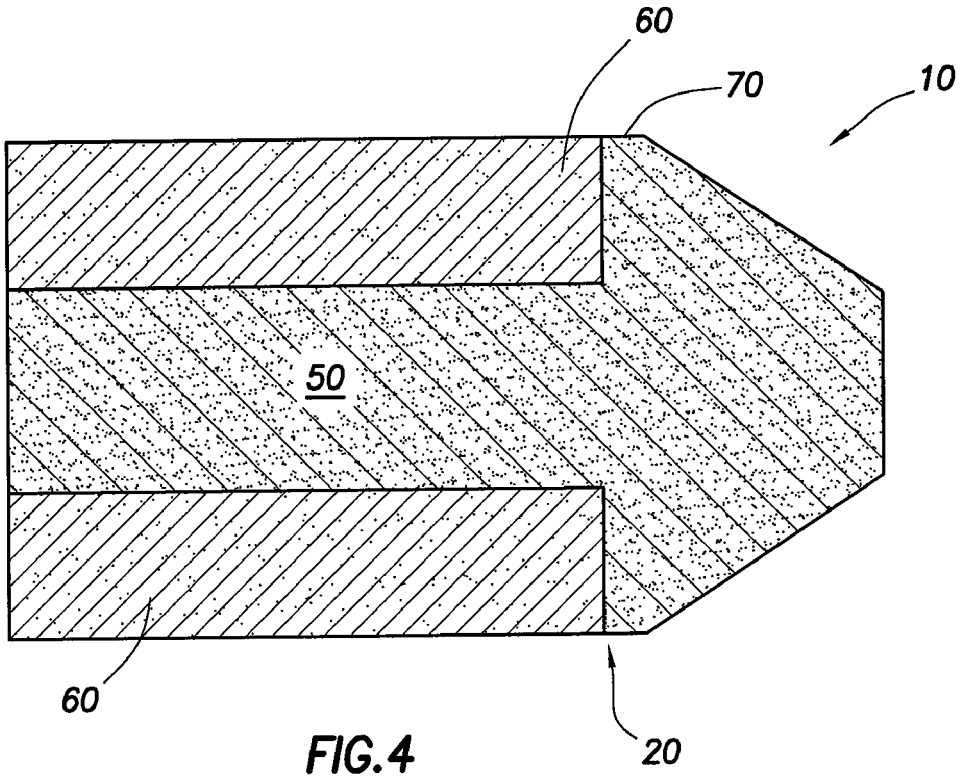
FIG. 4 is a side view of a foam dart in accordance with still another embodiment of the present invention.

In one embodiment, foam body 20 has at least two different compositions. For example, as illustrated in FIGS. 2-4, foam body 20 may include a core of foam 50 attached to nosepiece 40 (shown in FIG. 2). Core 50 may be surrounded by outer portion 60 of foam body 20. Core 50 may be formed such that portions of core 50 have a diameter approximately equal to the diameter of outer portion 60, while other portions of core 50 have a smaller diameter than the diameter of outer portion 60. Alternatively, core 50 may have a uniform diameter that is smaller than the diameter of outer portion 60. In this embodiment, foam body 20 may be sized to achieve adequate clean up and displacement in larger of casing and liner above a severe restriction and core 50 may be sized to achieve adequate clean up and displacement in casing and liner below restriction 90 (shown in FIG. 5B).

One embodied multi-layer dart may include a composite mandrel 30 with a threaded insert bonded into the lower portion of a urethane mandrel which runs the entire length of dart 10, surrounded by an open cell foam core 50 having an air flow rating of 1 cfm or less, which is surrounded by a reticulated foam outer portion 60 having an air flow rating of 6 cfm or greater. In another exemplary embodiment, core 50 may have a hardness of about 90 IFD and outer portion 60 may have a hardness of 50 IFD.

Mandrel 30 may be generally cylindrical, or any of a number of other shapes. Additionally, mandrel 30 may have a substantially constant cross section, or variances may be allowed to allow for ribs or other variances along the outer surface, such that foam body 20 may engage mandrel 30. Dart 10 may have nosepiece 40 to sealingly engage a plug. Mandrel 30 and nosepiece 40 may be integrally formed, or otherwise joined. Nosepiece 40 may have a diameter or other radial dimension that is smaller than the corresponding diameter or radial dimension of foam body 20. Nosepiece 40 may be a separate component attached to a leading end of mandrel 30. In certain embodiments, the leading end of mandrel 30 and an inner bore of nosepiece 40 may both be threaded, allowing the use of other shaped nosepieces in accordance with the desired shape for the plug with which dart 10 will interact. For example, nosepiece 40 may be tapered to facilitate entry of dart 10 into the plug.

Dart 10 may have a major outer diameter length that is approximately 1.5 times the major outer diameter for reasons of stability. Mandrel 30, nosepiece 40, or both may be constructed from any material suitable for use in the subterranean environment in which dart 10 will be placed. For example, mandrel 30 and/or nosepiece 40 may be constructed from a drillable material such as plastics, phenolics, composite materials, high strength thermoplastics, aluminum, glass, and/or brass.

Figures 5A, 5B, 5C:
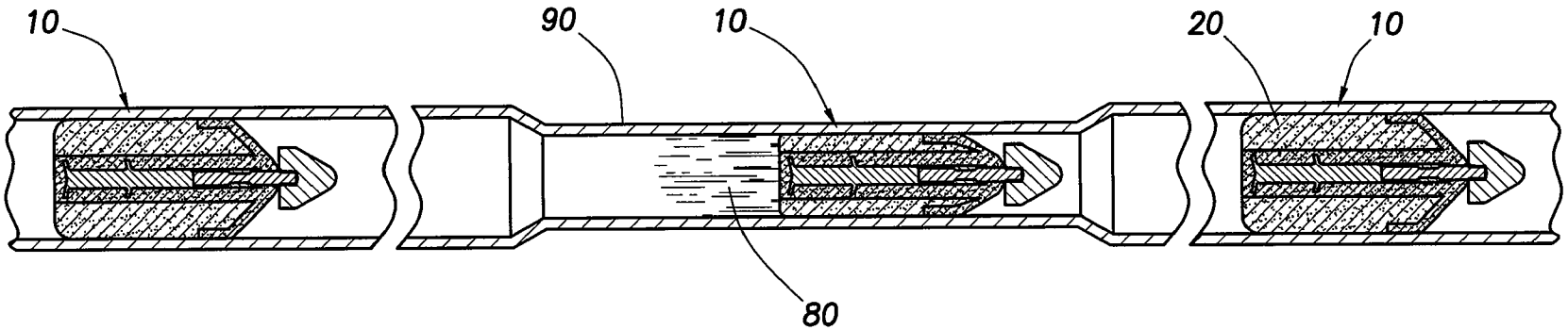
FIG. 5 is a schematic showing a foam dart as it passes through a work string in accordance with an embodiment of the present invention.

Referring to FIGS. 5A-5C, dart 10 may progress down a work string (FIG. 5A) while maintaining contact with the work string through various restrictions. As dart 10 is compressed radially (FIG. 5B), particulate fluid 80 is squeezed from the foam matrix, as indicated by the material behind dart 10 in restriction 90. As dart 10 exits restriction 90 (FIG. 5C), particulated fluid 80 is reabsorbed into foam body 20.

Thus, dart 10 may be capable of cleaning and displacing in a large-size work string and/or liner, passing through one or more severe restrictions, and then cleaning and displacing in a smaller size pipe and/or tool before landing on a seat. Dart 10 may be introduced into a drill pipe, casing, or other tubular string within the well bore at the surface. Dart 10 may then be moved through the tubular string until it reaches restriction 90. This movement may be caused via pumping down the tubular string and/or differential pressure. Dart 10 may be allowed to compress radially as it moves through restriction 90, and allowed to expand to maintain contact with the tubular string after passing through restriction 90. Filtering material 25 may clean at least a portion of solids out of a fluid as it enters and radially expands dart 10. Dart 10 may continue through tubular string, causing it to travel through the drill pipe until it contacts the plug. Once nosepiece 40 has contacted its mating seat profile within the plug, a differential pressure may be applied across the sealing diameter of nosepiece 40 and its mating seat profile so as to "activate" the plug, or cause the plug to be deployed so as to carry out an intended function within the casing. For example, a plug may be activated to cause it to detach from a work string and travel through the casing in order to serve as a spacer between different fluids that are desirably segregated.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A dart comprising:

a foam body;

a filtering material at least partially covering the foam body; and a mandrel;

wherein the foam body surrounds the mandrel.

2. The dart of claim 1, further comprising a nosepiece at a leading end of the dart.

3. The dart of claim 1, wherein the filtering material comprises multiple layers.

4. The dart of claim 3, wherein an outermost of the multiple layers filters large solids and an inner layer filters small solids.

5. The dart of claim 1, wherein after the foam body has passed through a restriction, the filtering material cleans at least a portion of solids out of a fluid as it enters the foam body.

6. The dart of claim 1, wherein the dart is constructed of drillable material.

7. The dart of claim 1, wherein the mandrel is constructed of drillable material.

8. The dart of claim 7, wherein the drillable material is selected from the group consisting of: aluminum, plastic, brass, a phenolic, a high-strength thermoplastic, glass, and a composite.

9. The dart of claim 1, wherein the foam body is constructed of a material selected from the group consisting of: natural rubber, nitrile rubber, styrene butadiene rubber, and polyurethane.

10. A method of cleaning a tubular string comprising:

introducing a dart having a foam body at least partially covered by a filtering material into the tubular string;

moving the dart through the tubular string toward a restriction;

allowing the dart to compress radially to move through the restriction; and allowing the dart to expand radially to maintain contact with the tubular string after passing through the restriction.

11. The method of claim 10, further comprising:

allowing the filtering material to clean at least a portion of solids out of a fluid as it enters the foam body to radially expand the dart.

* * * * *